US005128017A

United States Patent [19]

Delbianco et al.

[11] Patent Number: 5,128,017

[45] Date of Patent: Jul. 7, 1992

[54] SINGLE-STEP COAL LIQUEFACTION PROCESS

[75] Inventors: Alberto Delbianco, Magenta; Ermanno Girardi, San Donato Milanese, both of Italy

[73] Assignee: Eniricerche, S.p.A., Milan, Italy

[21] Appl. No.: 653,513

[22] Filed: Feb. 11, 1991

Related U.S. Application Data

[62] Division of Ser. No. 247,855, Sep. 22, 1988, Pat. No. 5,017,282.

[30] Foreign Application Priority Data

Oct. 2, 1987 [IT] Italy ..... 2119 A/87

[51] Int. Cl.[5] ..... C10G 1/06

[52] U.S. Cl. ..... 208/414; 208/419; 208/421; 208/433; 208/435

[58] Field of Search ..... 208/414, 419, 421, 433, 208/435

[56] References Cited

U.S. PATENT DOCUMENTS

| | | | |
|---|---|---|---|
| 3,642,607 | 2/1972 | Seitzer | 208/433 |
| 3,930,984 | 1/1976 | Pitchford | 208/433 |
| 4,486,293 | 12/1984 | Garg | 208/433 |
| 4,968,414 | 11/1990 | Delbianco et al. | 208/414 |

*Primary Examiner*—Paul Lieberman
*Assistant Examiner*—Mary DiNunzio
*Attorney, Agent, or Firm*—Birch, Stewart, Kolasch & Birch

[57] ABSTRACT

A process for the single-step coal liquefaction is disclosed, which comprises reacting coal in an aqueous suspension with carbon monoxide in the presence of a CO-conversion catalyst selected from the group consisting of an alkaline hydroxide and a carbonate, and in the presence of a hydrogenation catalyst selected from the group consisting of transition metals and compounds thereof, by operating at temperatures within the range of from 300° to 450° C. for a reaction time within the range of from 30 to 80 minutes.

12 Claims, No Drawings

SINGLE-STEP COAL LIQUEFACTION PROCESS

This application is a divisional of copending application Ser. No. 07/247,855 filed on Sep. 22, 1988, now U.S. Pat. No. 5,017,282.

BACKGROUND OF THE INVENTION

1. Field of the Invention

The present invention relates to a process for the single-step liquefaction of coal.

2. Description of Related Art

Processes for coal liquefaction are known, which use carbon monoxide, water and a suitable catalyst in order to produce in situ the necessary hydrogen for liquifying coal.

From these processes a mixture of hydrocarbons is obtained, which is constituted by asphaltene precursors, asphaltenes and oils (respectively indicated hereinunder in the present patent applications as "PA", "A", "OILS"), in different mutual ratios according to the adopted operating conditions.

SUMMARY OF THE INVENTION

The present Applicant has surprisingly found that by adding to these processes a hydrogenation catalyst, the hydrogen produced by the conversion of CO, and present in the reaction environment, can be better used by the liquefaction process, improving the quality of the products in terms of mutual distribution of PA, A, OILS, as well as of H/C ratio of the same reaction products.

The so-obtained products can be used as intermediates for the production of liquid derivatives from coal.

The process according to the present invention for the single-step liquefaction of coal, comprises reacting the coal in an aqueous suspension with carbon monoxide in the presence of a CO conversion catalyst selected from the group consisting of an alkaline hydroxide and a carbonate, wherein the reaction takes place in the presence of a hydrogenation catalyst selected from the group consisting of transition metals and compounds thereof, by operating at temperatures within the range of from 300° to 450° C., and for a reaction time within the range of from 30 to 80 minutes.

DETAILED DESCRIPTION OF THE INVENTION

The pressure under which the liquefaction of coal takes place depends both on the amount of water which is charged together with the coal to the reaction system, i.e., in the aqueous coal suspension, which should preferably be in a weight ratio within the range of from 2/1 to 5/1 relatively to the coal used as the starting material; and on the partial pressure of charged carbon monoxide, which should be preferably within the range of from 40 to 80 atm; said pressure is preferably selected within a range of from 150 to 300 atm.

Sodium and potassium hydroxides and carbonates are the preferred catalysts for the reaction of conversion of CO to $CO_2$ and $H_2$.

The hydrogenation catalysts, per se known, can be, e.g., Ni, Mo, Co, Fe oxides or sulphides, and so forth, which can be directly added or produced in situ by decomposition of soluble salts.

The amount of said hydrogenation catalysts should be preferably either smaller than, or equal to, 1% by weight relative to the coal fed to the reaction.

The temperature can be kept essentially constant during the whole reaction time, and equal to a value within the range of from 380° to 440° C., or it can be kept for a time of up to 20 minutes, and preferably within the range of from 5 to 20 minutes, at a value within the range of from 300° to 370° C., to be the increased over at time within the range of from 20 to 40 minutes, up to a value within the range of from 420° to 450° C., at which value it can be kept for a time of up to 20 minutes, and preferably within the range of 5 to 20 minutes.

During the liquefaction process, water is at a temperature close to, or higher than, the critical temperature, determining a density of the reaction medium within the range of from 0.07 to 0.2 g/ml.

In order to better illustrate the meaning of the present invention, an example is reported hereinunder, which is not to be considered as being limitative of the invention.

EXAMPLE 1

The test was carried out on an Illinois Nr. 6 coal, the elemental analysis of which is shown in Table 1.

One gram of coal was treated with an aqueous solution of ammonium heptamolybdate, and then dried, so as to obtain a coal impregnated with the catalyst at a concentration of 0.2% of Mo per coal gram.

The catalyst-impregnated coal was then charged to a reactor of 30 ml of capacity, together with 4 ml of a 0.1M aqueous solution of $Na_2CO_3$.

The reactor was then pressurized with 40 atm of carbon monoxide; it was then heated to 400° C. and maintained at this temperature for 60 minutes.

When the reaction was ended, the reactor was discharged and, after eliminating the aqueous phase, the reaction product was recovered with tetrahydrofuran (THF).

The product fraction soluble in THF was then filtered off from the unreacted coal and mineral materials.

The THF-soluble material was then furthermore treated with hexane in soxhlet, in order to separate the fraction constituted by the oils.

In total, by starting from 1 g of dmmf coal (dmmf=dry mineral matter free), when the process was finished, more than 0.9 g was recovered of a mixture of mostly non-distillable, THF-soluble hydrocarbons, 35% of which were soluble in paraffinic solvents (oils).

The degree of hydrogenation of the mixture of THF-soluble products was increased by increasing the H/C ratio from 0.82 (the starting coal) to 1.05.

The hydrogen used by the liquefaction system and computed on the basis of the gas-chromatographic analysis of the gas mixture recovered at the reaction end was of 20 mg/g of dmmf coal.

EXAMPLE 2 (COMPARATIVE EXAMPLE)

Still on 1 g of Illinois Nr. 6 coal, a test analogous to the preceding one was carried out, but without using the hydrogenation catalyst (ammonium heptamolybdate).

Under the same reaction conditions, at the end of the process more than 0.9 g was recovered of a mixture of no longer distillable, THF-soluble hydrocarbons (H/C=1.00), 26% of which were soluble in paraffinic solvents (oils). In this case, the hydrogen used by the system was of 16 mg/g of dmmf coal.

Therefore, the use of a hydrogenation catalyst made it possible a mixture of hydrocarbons to be obtained, wherein the hydrocarbons soluble in paraffinic oils (oils) had increased from 26% to 35%. Furthermore, with the gaseous hydrocarbons produced being the same, an increase in use of hydrogen of about 20% was observed.

TABLE 1

Immediate and End Analysis of Illinois Nr. 6 Coal

| | | Air Dried | Dry | dmmf* |
|---|---|---|---|---|
| Moisture | % | 4.57 | | |
| Ashes | % | 11.43 | 11.98 | |
| Volatile matters | % | 35.74 | 37.45 | 44.01 |
| Fixed Carbon | % | 48.26 | 50.57 | 55.99 |
| Carbon | % | 66.42 | 69.60 | 81.79 |
| Hydrogen | % | 5.06 | 4.77 | 5.60 |
| Nitrogen | % | 1.50 | 1.57 | 1.85 |
| Sulphur | % | 3.43 | 3.59 | |
| Oxygen (diff.) | % | 12.16 | 8.49 | 10.76 |

*Mineral matter = 14.91%, evaluated according to Parr Method.

We claim:

1. A process for a single-step liquefaction of coal, which comprises:

reacting coal in an aqueous suspension with carbon monoxide in the presence of a carbon monoxide conversion catalyst selected from the group consisting of an alkaline hydroxide and a carbonate, wherein the reaction occurs in the presence of a hydrogenation catalyst selected from the group consisting of transition metals and compounds thereof, by operating at temperatures within the range of from 300° to 450° C., and a for reaction time within the range of from 30 to 80 minutes, said reaction forming hydrogen in situ.

2. The process according to claim 1, wherein the hydrogenation catalyst is present in an amount smaller than, or equal to, 1% by weight relative to the coal.

3. The process according to claim 1, wherein the temperature is maintained essentially constant and equal to a value within the range of from 380° to 440° C.

4. The process according to claim 1, wherein the weight ratio of water and coal in the aqueous suspension is in the range of from 2:1 to 5:1 relative to the coal used as a starting material.

5. The process according to claim 1, wherein the partial pressure of the carbon monoxide is within the range of from 40 to 80 atm.

6. The process according to claim 1, wherein the pressure under which the liquefaction of coal takes place is within the range of from 150 to 300 atm.

7. The process according to claim 1, wherein the alkaline hydroxide is selected from the group consisting of sodium and potassium hydroxide.

8. The process according to claim 1, wherein the hydrogenation catalyst is a nickel, molybdenum, cobalt, iron oxide, or iron sulphide catalyst.

9. The process according to claim 1, wherein the temperature is maintained essentially constant during the whole reaction time at a temperature in the range of 380° to 440° C.

10. The process according to claim 1, wherein during the liquefaction process, water is at a temperature close to, or higher than, the critical temperature, so that the density of the reaction medium is within the range of from 0.07 to 0.2 g/ml.

11. A process for the liquefaction of coal, which comprises:

impregnating coal with an aqueous solution, adjusting the weight ratio of water and coal in an aqueous suspension to be in a range of from 2:1 to 5:1 and reacting coal in the aqueous suspension with carbon monoxide in the presence of a carbon monoxide conversion catalyst selected from the group consisting of an alkaline hydroxide and a carbonate, wherein the reaction occurs in the presence of a hydrogenation catalyst selected from the group consisting of transition metals and compounds thereof, by operating at temperatures within the range of from 300° to 450° C., and for a reaction time within the range of from 30 to 80 minutes, said reaction forming hydrogen in situ.

12. A process for a single-step the liquefaction of coal, which comprises:

reacting coal in an medium consisting essentially of an aqueous suspension with carbon monoxide in the presence of a carbon monoxide conversion catalyst selected from the group consisting of an alkaline hydroxide and a carbonate, wherein the reaction occurs in the presence of a hydrogenation catalyst selected from the group consisting of transition metals and compounds thereof, by operating at temperatures within the range of from 300° to 450° C., and for a reaction time within the range of from 30 to 80 minutes, said reaction forming hydrogen in situ.

* * * * *

UNITED STATES PATENT AND TRADEMARK OFFICE

CERTIFICATE OF CORRECTION

PATENT NO. : 5,128,017

DATED : July 7, 1992

INVENTOR(S) : Alberto Delbianco et al.

It is certified that error appears in the above-identified patent and that said Letters Patent is hereby corrected as shown below:

On the title page item: "[30] Foreign Application Priority Data" change "2119 A/87" to --22119 A/87--

Signed and Sealed this

Twenty-third Day of November, 1993

*Attest:*

*Attesting Officer*

Bruce Lehman

BRUCE LEHMAN

*Commissioner of Patents and Trademarks*